US009963896B2

(12) United States Patent
Heffernan

(10) Patent No.: US 9,963,896 B2
(45) Date of Patent: May 8, 2018

(54) POOL CLEANER WITH REMOVABLE BATTERY PACK

(71) Applicant: Glen Heffernan, Reseda, CA (US)

(72) Inventor: Glen Heffernan, Reseda, CA (US)

( * ) Notice: Subject to any disclaimer, the term of this patent is extended or adjusted under 35 U.S.C. 154(b) by 0 days. days.

(21) Appl. No.: 14/970,283

(22) Filed: Dec. 15, 2015

(65) Prior Publication Data

US 2016/0273238 A1 Sep. 22, 2016

Related U.S. Application Data

(63) Continuation-in-part of application No. 14/660,330, filed on Mar. 17, 2015, now Pat. No. 9,828,785.

(51) Int. Cl.
*E04H 4/16* (2006.01)

(52) U.S. Cl.
CPC ..... *E04H 4/1618* (2013.01); *E04H 4/1636* (2013.01)

(58) Field of Classification Search
CPC ..... E04H 4/1636; E04H 4/1618
USPC ..... 210/167.16, 167.17, 238; 15/1.7
See application file for complete search history.

(56) References Cited

U.S. PATENT DOCUMENTS

| | | | | |
|---|---|---|---|---|
| 4,651,376 | A * | 3/1987 | Ford | E04H 4/1654 15/1.7 |
| 6,502,269 | B1 * | 1/2003 | Balchan | E04H 4/1636 15/1.7 |
| 2004/0025268 | A1 * | 2/2004 | Porat | E04H 4/1654 15/1.7 |
| 2015/0128361 | A1 * | 5/2015 | Erlich | E04H 4/1636 15/1.7 |

* cited by examiner

*Primary Examiner* — Fred Prince
(74) *Attorney, Agent, or Firm* — James A. Italia; Italia IP

(57) ABSTRACT

A mobile filter for removing solid contaminants from water such as swimming pools. The mobile filter has a handle maneuvered chassis, a powered propeller housed in a propeller housing, which propeller propels water through a removable bag mesh filter installable on the propeller housing. A submersible battery pack is slidably coupled to the handle, and is readily removable therefrom. An electrical conductor spans and connects the submersible battery pack and the submersible electric motor.

19 Claims, 10 Drawing Sheets

POOL CLEANER WITH REMOVABLE BATTERY PACK

REFERENCE TO RELATED APPLICATION

This application is a Continuation-in-Part of U.S. application Ser. No. 14/660,330, filed on Mar. 17, 2015, the contents of which are incorporated herein by reference.

FIELD OF THE DISCLOSURE

The present disclosure relates to manually maneuvered, wheeled, powered mobile filters for swimming pools and the like.

BACKGROUND

Swimming pools and other water filled structures periodically collect contaminants. In the case of structures open to the atmosphere, particularly outdoors, leaves and trash may settle on the water. Operators of water filled structures must periodically remove such contaminants.

Mobile filters have been proposed for this task. However, most mobile filters are encumbered with objectionable electrical or vacuum connections, and are hard to maneuver manually. There remains a need for improved mobile powered filters. Notably, in an electrically powered mobile filter, there exists a need for a readily removed and replaced battery pack that resists ingress of water and is readily reconnected electrically after being replaced on the mobile filter.

SUMMARY

The disclosed concepts address the above stated situation by providing a mobile filter which is powered, readily maneuvered, and free from the above noted encumbrances. To this end, there is disclosed a mobile filter having a wheeled chassis, a powered propeller contained within a body, and a removable bag mesh filter installable on the body. Notably, the propeller is powered by a submersible electric motor. A submersible battery pack is slidably received on a handle of the mobile filter. The submersible battery pack has a flexible or rigid electrical supply conductor extending between the submersible battery pack and the submersible electric motor. The submersible battery pack is separate and removable from the chassis and other significant component of the mobile filter. Electrical connectors resist ingress by water. The submersible battery pack is slidably received over the handle of the chassis. Locating the submersible battery pack on the handle mitigates objectionable weight of the submersible battery pack, which might otherwise interfere with maneuverability. In addition, the submersible battery pack is designed to work with various sized batteries thereby allowing a user to change the battery pack design and still use the existing mobile filter having a wheeled chassis via the corresponding submersible connector head or an IP65 underwater connector. The battery pack may be adapted to slide along the handle, so that the submersible battery pack is easy to install and remove. This is an advantage when the submersible battery pack is depleted, and must be replaced with a different submersible battery pack, or removed for recharging. The submersible connectors obviously contribute to ease of installation and removal of the submersible battery pack.

It is an object to provide improved elements and arrangements thereof by apparatus for the purposes described which is inexpensive, dependable, and fully effective in accomplishing its intended purposes.

This and other objects will become readily apparent upon further review of the following specification and drawings.

BRIEF DESCRIPTION OF THE DRAWINGS

Various objects, features, and attendant advantages of the disclosed concepts will become more fully appreciated as the same becomes better understood when considered in conjunction with the accompanying drawings, in which like reference characters designate the same or similar parts throughout the several views, and wherein.

DETAILED DESCRIPTION

Figure 1:
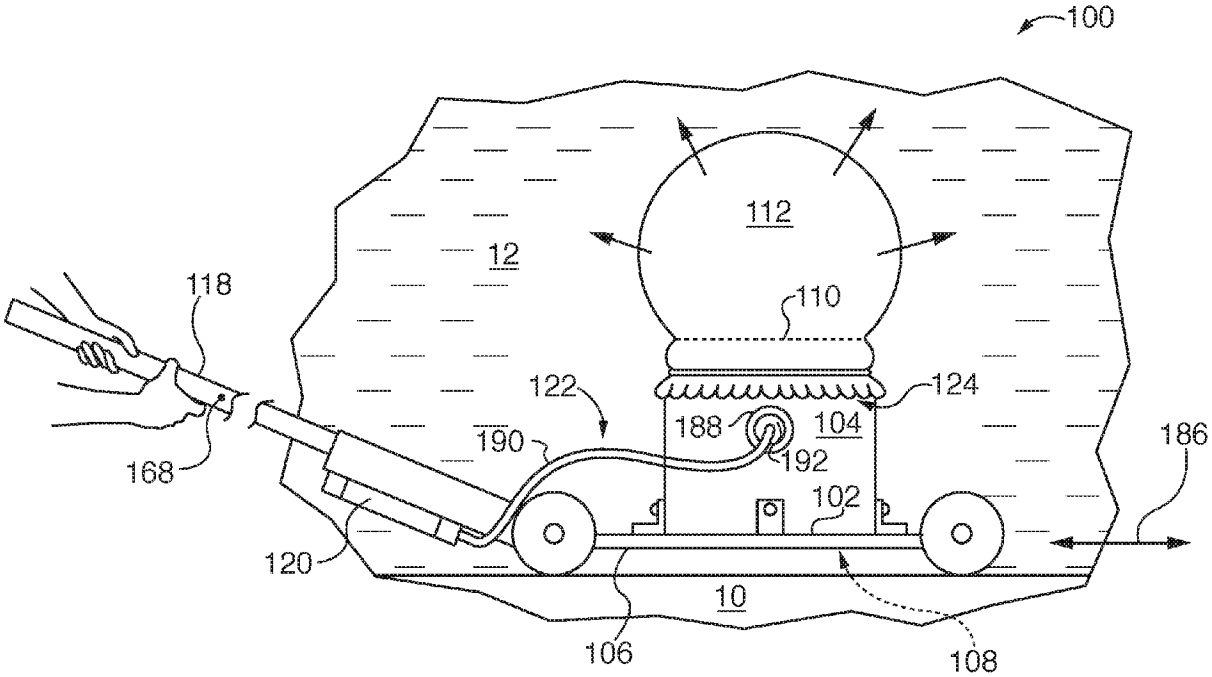
FIG. 1 is a diagrammatic environmental side view of a mobile powered filtering appliance, according to at least one aspect of the disclosure.
Figure 3:
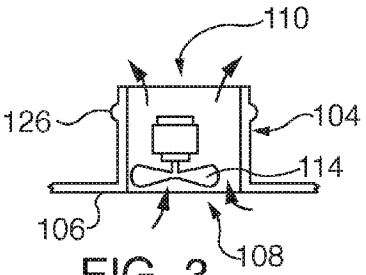
FIG. 3 is a cross sectional side detail view of the lower portion of FIG. 1.
Figure 2:
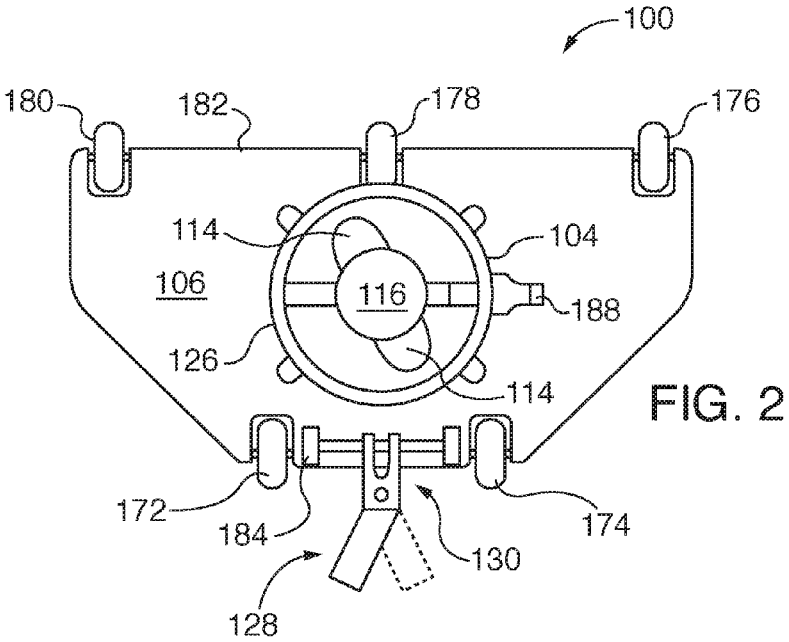
FIG. 2 is a diagrammatic top view of the appliance of FIG. 1, with a bag filter shown in FIG. 1 omitted in FIG. 2.

Referring first to FIGS. 1 and 2, according to at least one aspect of the disclosure, there is shown a mobile powered filtering appliance 100 for filtering solid objects (not shown) from a structure 10 containing water. Mobile powered filtering appliance 100 comprises a chassis assembly, which in turn further comprises a chassis 102, a propeller 114 and a propeller housing 104 mounted to chassis 102, a submersible electric motor 116 drivingly coupled to propeller 114, and an elongated handle 118 coupled to chassis 102. A submersible battery pack 120 is separate from and attachable to the chassis assembly. An electrical conductor 122 electrically connects submersible electric motor 116 to submersible battery pack 120.

Mounting of submersible battery pack 120 to elongated handle 118 minimizes burden of maneuvering mobile powered filtering appliance 100.

In the example of FIGS. 1 and 2, electrical conductor 122 comprises a flexible power cord 190, and therefore is flexible along at least part of its length.

Figure 10:
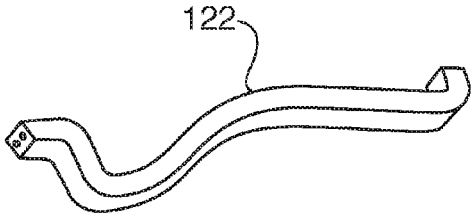
FIG. 10 is a perspective view of an alternative to an electrical conductor shown at the center of FIG. 1.

Electrical conductor 122, which will be understood to include at least two individual conductors and necessary electrical insulation and jacketing, need not be flexible, although flexibility makes it easier to maneuver electrical conductor 122 for plugging in to submersible electrical connector 188. Instead, electrical conductor 122 could be replaced or supplemented by an electrical conductor assembly 194 (FIG. 10) rigid along at least part of its length. In further alternatives, electrical conductor 122 could be flexible along only part of its length, could comprise rigid sections having intervening flexible joints, or could comprise more than one flexible power cords, including at least one flexible power cord integral with either or both of submersible electric motor 116 and submersible battery pack 120 (these variations are not shown).

Submersible battery pack 120 may be a lithium ion type. Lithium ion batteries minimize the weight contribution of submersible battery pack 120, thereby helping to minimize effort of maneuvering mobile powered filtering appliance 100. Submersible battery pack may have a nominal voltage rating between 12 and 20 volts. Voltages in this range contribute to inherently safe usage characteristics while still providing sufficient power capacity to avoid requiring frequent battery recharging or replacement.

Figure 11:
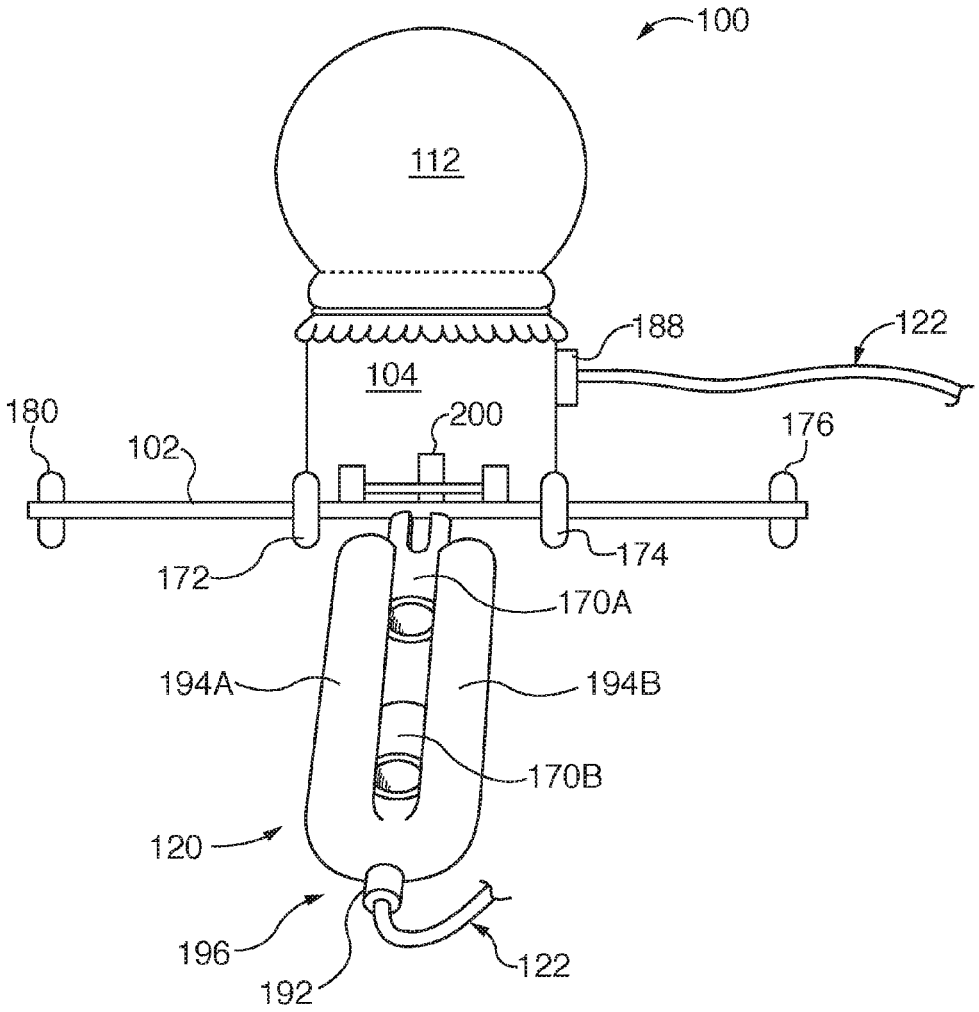
FIG. 11 is a partially perspective view of a mobile powered filtering apparatus, according to at least one further aspect of the disclosure.

Referring to FIG. 11, battery pack 120 includes two parallel battery compartments 194A, 194B mutually communicating at one end 196 of each of the two parallel battery compartments 194A, 194B. In the example of FIG. 11, electrical conductor 122 exits battery pack 120 at the mutually communicating end 196 of each of the two parallel battery compartments 194A, 194B. For the purposes of this disclosure, reference to electrical conductor 122 as exiting battery pack 120 at end 196 will be understood to encompass connection at a terminal, such as submersible terminal 192.

Figure 4:
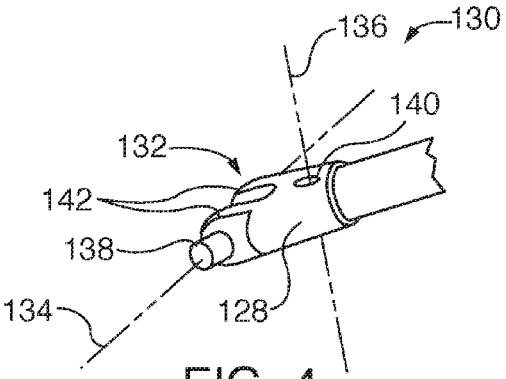
FIG. 4 is a perspective detail view of a mechanical connection usable with the appliance of FIG. 1.

Elongated handle 118 may be removably coupled to chassis 102 at a socket 128 (FIG. 2) which may be permanently mounted to chassis 102. In the absence of socket 128, elongated handle 118 may be directly coupled to chassis 102, or as illustrated, may engage socket 128. In the latter case, socket 128 engages chassis 102. Mobile powered filtering appliance 100 may comprise a flex joint 130 connecting elongated handle 118 to chassis 106. Flex joint 130 may comprise a universal joint 132 (FIGS. 2 and 4). As seen in FIG. 4, universal joint 132 comprises two perpendicular pivot axes 134, 136 provided by axles 138, 140 supported in a yoke 142 or the tubular portion of socket 138, respectively (FIG. 4).

Figure 5:
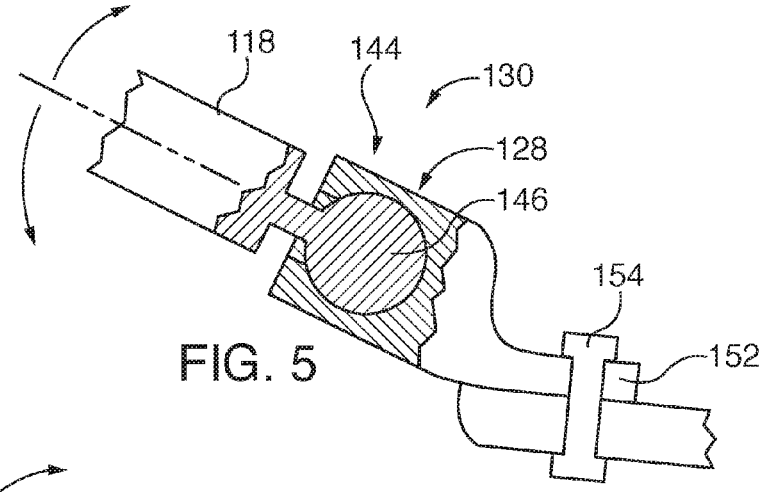
FIG. 5 is a side detail view of an alternative to the mechanical connection of FIG. 4, shown partly in cross section.

As an alternative to a universal joint, and referring to FIG. 5, flex joint 130 may comprise a ball and socket assembly 144. Elongated handle 118 may be coupled to ball 146 by a suitable detent device, such as a threaded coupling (not shown), a bayonet connection (not shown), a through pin such as through pin 148 of FIG. 6, or a deflectable, spring mounted interference finger such as spring mounted interference finger 150 of FIG. 7, which will be further described hereinafter. Other types of detent devices (none shown) may be provided if desired. In FIG. 5, socket 128 is coupled to chassis 102 by a tang 152, which tang 152 may be secured by a fastener such as a nut and bolt combination 154.

Figure 6:
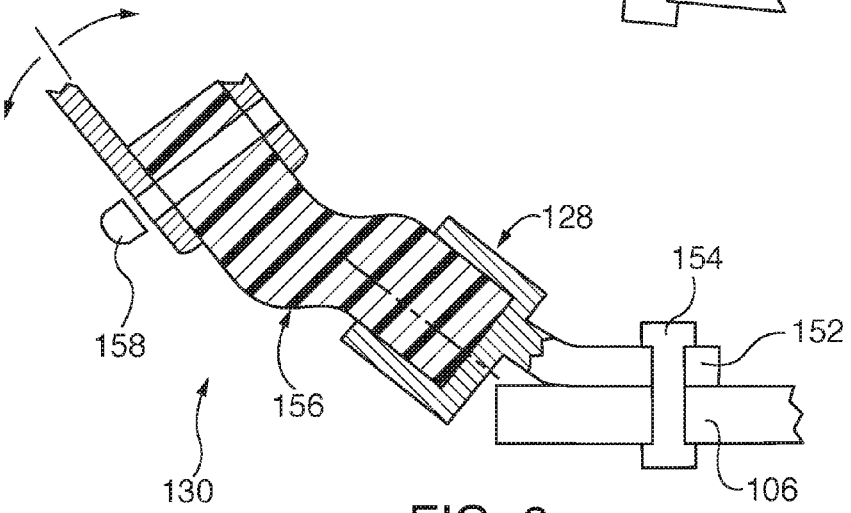
FIG. 6 is a side detail view of still another alternative to the mechanical connection of FIG. 4, shown partly in cross section.

Referring specifically to FIG. 6, flex joint 130 comprises a flexible link 156 spanning and connecting chassis 102 and elongated handle 118. Flexible link 156 may comprise any flexible material, such as stranded metallic or polymeric cable, flexible rubber or plastic, or a chain (not shown), among others. In the example of FIG. 6, flexible link 156 may be secured to either or both of elongated handle 118 and socket 128 by a through pin (i.e., nut and bolt combination 158, 160), by crimping, or in any other suitable way. In FIG. 6, socket 128 is coupled to chassis 102 by tang 152 by nut and bolt combination 154.

As a further alternative, elongated handle 118 may engage socket 128 by friction fit (not shown).

In FIGS. 1, 2, 3, 5, and 6, chassis 102 is depicted as a planar platform, but may of course take other forms, such as for example a skeleton (not shown) having openings which would be visible for example in the top view of FIG. 2.

Propeller housing 104 is depicted as being cylindrical herein. However, propeller housing could if desired take on other configurations, internally, externally, or both.

Structure 10 may be a swimming pool (only the floor portion is shown in FIG. 1). Propeller 114 is arranged to propel water 12 upwardly, as shown in FIG. 1, so that water 12 enters filter 112. Filter 112 is adapted to arrest debris (such as leaves, not shown) in water propelled by propeller 114. As employed herein, adaptation to arrest debris means that filter 112 is located in the stream of water propelled by propeller 114, and has sufficiently small mesh size as to entrap commonly encountered contaminants As seen in FIG. 1, second end 110 of propeller housing 104 is oriented to discharge water 12 upwardly relative to the direction of motion or travel of chassis 102 along structure 10 containing water 12. Direction of motion of chassis 102 is indicated by an arrow 186. Discharge of water 12 upwardly will oppose side thrusts which might influence the direction of motion in an unintended way.

It would also be possible to arrange second end 110 to be directed such that a degree of thrust assists mobile powered filtering appliance 100 to move in the direction of motion (this option is not shown).

It should be noted at this point that orientational terms such as "upwardly" refer to the subject drawing as viewed by an observer. The drawing figures depict their subject matter in orientations of normal use, which could obviously change with changes in appliance position. Therefore, orientational terms must be understood to provide semantic basis for purposes of description only, and do not imply that their subject matter can be used only in one position.

The above is not to imply that mobile powered filtering appliance 100 can only be used with chassis 102 horizontally oriented. It would be possible to operate at an incline relative to the orientation shown in FIG. 1, particularly since thrust arising from propeller 114 will tend to urge mobile powered filtering appliance 100 in the opposite direction of discharge of water 12 from propeller housing 104.

Figure 9:
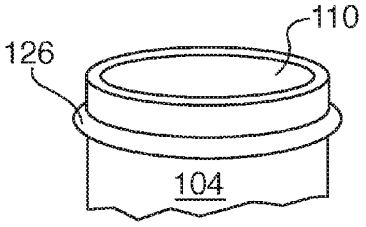
FIG. 9 is a perspective detail view of the center of FIG. 1, with a bag type filter omitted to reveal detail.

Filter 112 is removably attachable to propeller housing 104. Filter 112 is a bag type filter having an opening 124 capable of closing over propeller housing 104. Propeller housing 104 may comprise an outward projection 126 about a circumference of propeller housing 104. The bag type filter may be retained on propeller housing 104 by tightening opening 124 of the bag type filter on propeller housing 104 between outward projection 126 and chassis 102. The bag type filter may include a drawstring or elastic ring about the neck of the bag. When constricted by the drawstring or elastic ring, the neck of the bag will be prevented from sliding off propeller housing 104 by interference with outward projection 126. Outward projection 126 is depicted herein as extending along the entire circumference of propeller housing 104 (see FIG. 9). However, it will be recognized that outward projection 126 may be discontinuous, for example, comprising two or more separated sections or individual outward projections (this option is not shown).

Figure 7:
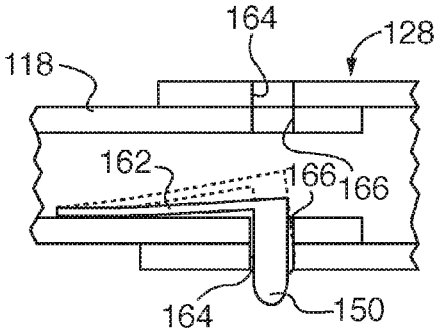
FIG. 7 is a side cross sectional detail view of a manual detent which may be incorporated into the structure shown in, for example, FIGS. 5 and 6.

Elongated handle 118 may be manually removable from chassis 102. Manually removable signified that no tools need be provided to release elongated handle 118 from engagement with socket 128 or alternatively from direct engagement with chassis 106. FIG. 7 illustrated an arrangement wherein elongated handle 118 is manually removable from socket 128. Interference finger 150 is fixed to a deflectable spring arm 162 fixed to the interior of elongated handle 118. When holes 164 passing through elongated handle 118 are axially aligned with holes 166 passing through socket 128, interference finger 150 occupies two holes 164, 166 to establish interference preventing elongated handle 118 from disengaging from socket 128. Spring arm 162 is arranged to bias interference finger 150 into the interference position shown in solid lines. Spring characteristics of spring arm 162 are such that finger pressure is sufficient to move interference finger 150 out of the interference position, as indicated by dashed lines.

Manual removal of elongated handle 118 enables submersible battery pack 120 to be readily replaced.

Referring specifically to FIG. 1, submersible battery pack 120 is mounted to elongated handle 118. Submersible battery pack 120 is located between the geometric center point 168 of elongated handle 118 and chassis 102 when submersible battery pack 120 is mounted to elongated handle 118. This location minimizes adverse effects of the mass of submersible battery pack 120 on maneuverability of mobile powered filtering appliance 100.

Figure 8:
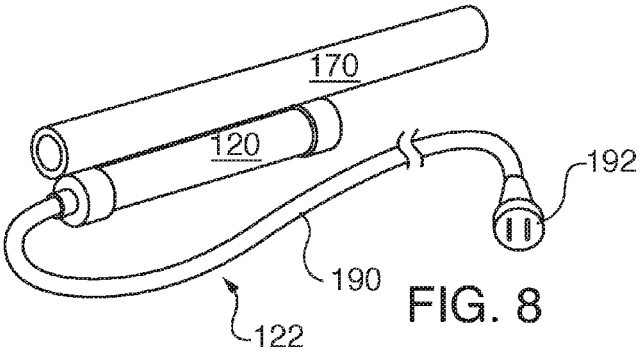
FIG. 8 is a perspective detail view of a battery shown at the lower left of FIG. 1.

Referring to FIGS. 1 and 8, submersible battery pack 120 further comprises a yoke which slidably engages elongated handle 118, whereby submersible battery pack 120 is slidably mountable to elongated handle 118. The yoke may take the form of a sleeve 170 which can be slipped over elongated handle 118.

Slidable engagement of elongated handle 118 expedites removal and installation of submersible battery pack 120. It is to be appreciated that the submersible battery pack 120 is adaptable to operate with various sized batteries. It is to be further appreciated that the submersible battery pack 120 can assume different submersible battery pack designs, as shown in FIGS. 1 and 11, for example. Moreover, in a preferred embodiment, the mobile powered filtering appliance 100 is further adapted to cooperate with various battery pack designs by utilizing the submersible electrical connector 188.

Referring to FIG. 2, mobile powered filtering appliance 100 may comprise a plurality of wheels 172, 174, 176, 178, 180 rotatably mounted to chassis 102. Wheels 172, 174, 176, 178, 180 facilitate travel of mobile powered filtering appliance 100 along solid surfaces such as the floor of structure 10 (FIG. 1).

The plurality of wheels 172, 174, 176, 178, 180 may include a first wheel 176 and a second wheel 180, both located on a side 182 of chassis 102 opposite elongated handle 118. The plurality of wheels 172,174, 176, 178, 180 may be limited to first and second wheels 176, 180. Two wheels located as described above would provide maximal maneuverability if the number of wheels were limited to two wheels (i.e., first and second wheels 176, 180).

The plurality of wheels may be increased from two wheels (first and second wheels 176, 180). To this end, mobile powered filtering appliance 100 may comprise a third wheel 178 located on side 182 of chassis 118 bearing elongated handle 118. Provision of third wheel 178 further stabilizes chassis 102 as mobile powered filtering appliance 100 traverses structure 10 (FIG. 1).

The plurality of wheels may be increased from two wheels (first and second wheels 176, 180, or from three wheels (first, second, and third wheels 176, 178, 180). To this end, mobile powered filtering appliance 100 may further comprise a fourth wheel 172 and a fifth wheel 174 located on a side 184 of chassis 102 bearing elongated handle 118, wherein the track of the first and second wheels 176, 180 is greater than the track of the fourth and fifth wheels 172, 174. Track is the distance between first and second wheels 176, 180, or between fourth and fifth wheels 172, 174. Fourth and fifth wheels still further improve stability of chassis 102 as mobile powered filtering appliance 100 traverses structure 10 (FIG. 1).

Fourth and fifth wheels 172, 174 may be present in the absence of wheel 178. Unless otherwise indicated, the terms "first", "second", etc., are used herein merely as labels, and are not intended to impose ordinal, positional, or hierarchical requirements on the items to which these terms refer. Moreover, reference to, e.g., a "second" item does not either require or preclude the existence of, e.g., a "first" or lower-numbered item, and/or, e.g., a "third" or higher-numbered item.

Referring to FIG. 11, submersible battery pack 120 comprises sleeves or yokes 170A, 170B adapted to engage and be retained on elongated handle 118 (see FIG. 8). In the example of FIG. 8, a single long yoke 170 is provided. In the example of FIG. 11, the same function is provided by yokes 170A, 170B. Referring to both FIGS. 11 and 12, chassis 102 and submersible battery pack 120 collectively include a keying arrangement constraining submersible battery pack 120 from rotating about elongated handle 118 when submersible battery pack 120 is in operative position mounted on elongated handle 118. Operative position is illustrated in FIG. 1.

Figure 12:
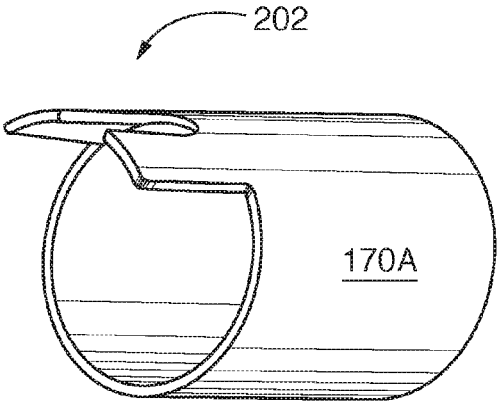
FIG. 12 is a perspective detail view of a component shown at the center of FIG. 11, and is drawn to enlarged scale.
Figure 13:
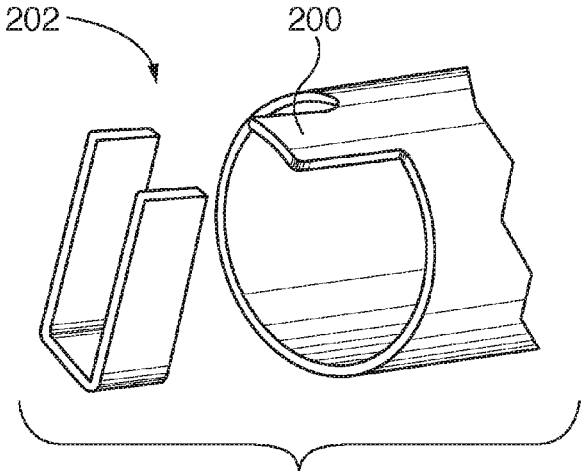
FIG. 13 is a perspective detail view of an alternative to the arrangement shown in FIG. 12.

One of chassis 102 and submersible battery pack 120 includes a tab 200 and another one of chassis 102 and submersible battery pack 120 includes a clevis or fork 202 configured to surround tab 200 in close cooperation therewith. As seen in the example of FIGS. 11 and 12, tab 200 is on chassis 102. In the example of FIG. 13, tab 200 is on battery pack 120. Fork 202 may be fixed to chassis 102 or alternatively, to support structure 204 for pivotally supporting elongated handle 118.

Referring to FIGS. 1, 2 and 8, in mobile powered filtering apparatus 100, submersible motor 116 includes a submersible electrical connector 188 accessible from an exterior of propeller housing 104. Electrical conductor 122 is integral with submersible battery pack 120 and terminates in a submersible terminal 192 configured to mechanically engage and electrically connect to submersible electrical connector 188 of submersible motor 116. In the example of FIGS. 1, 2, and 8, submersible electrical connector 188 of submersible motor 116 and submersible terminal 192 of electrical conductor 122 each meet IEC standard IP65.Conformity to standard IP65 both assures reasonable protection of ingress of water to energized electrical components, and also enables use of established or conventional electrical connectors when fabricating mobile powered filtering apparatus 100.

Figure 14:
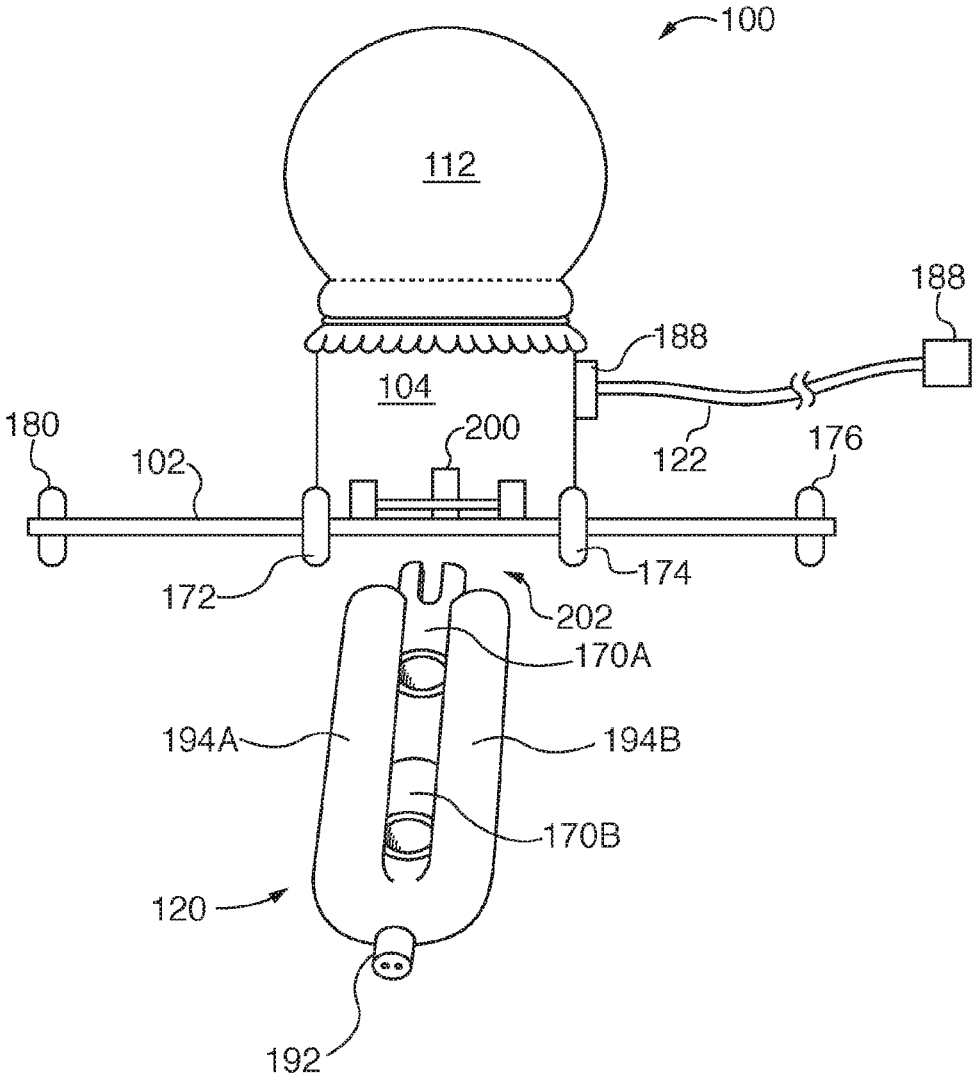
FIG. 14 is a partially perspective view of a mobile powered filtering apparatus, according at least one additional aspect of the disclosure.

Turning now to FIG. 14, there is shown a mobile powered filtering apparatus 100 wherein electrical conductor 122 is integral with submersible electric motor 116 (as shown in FIG. 2) and terminates in submersible electric connector 188. Submersible battery pack 120 comprises a submersible electrical terminal 192 configured to mechanically engage and electrically connect to submersible electrical connector 188 of electrical conductor 122 of submersible motor 116. Mobile powered filtering apparatus 100 of FIG. 14 is in other ways the structural and functional equivalent of mobile powered filtering apparatus 100 of FIG. 1. In mobile powered filtering apparatus 100 of FIG. 14, submersible electrical connector 188 of submersible motor 116 and submersible terminal 192 of electrical conductor 122 each meet IEC standard IP65.

Figure 15:
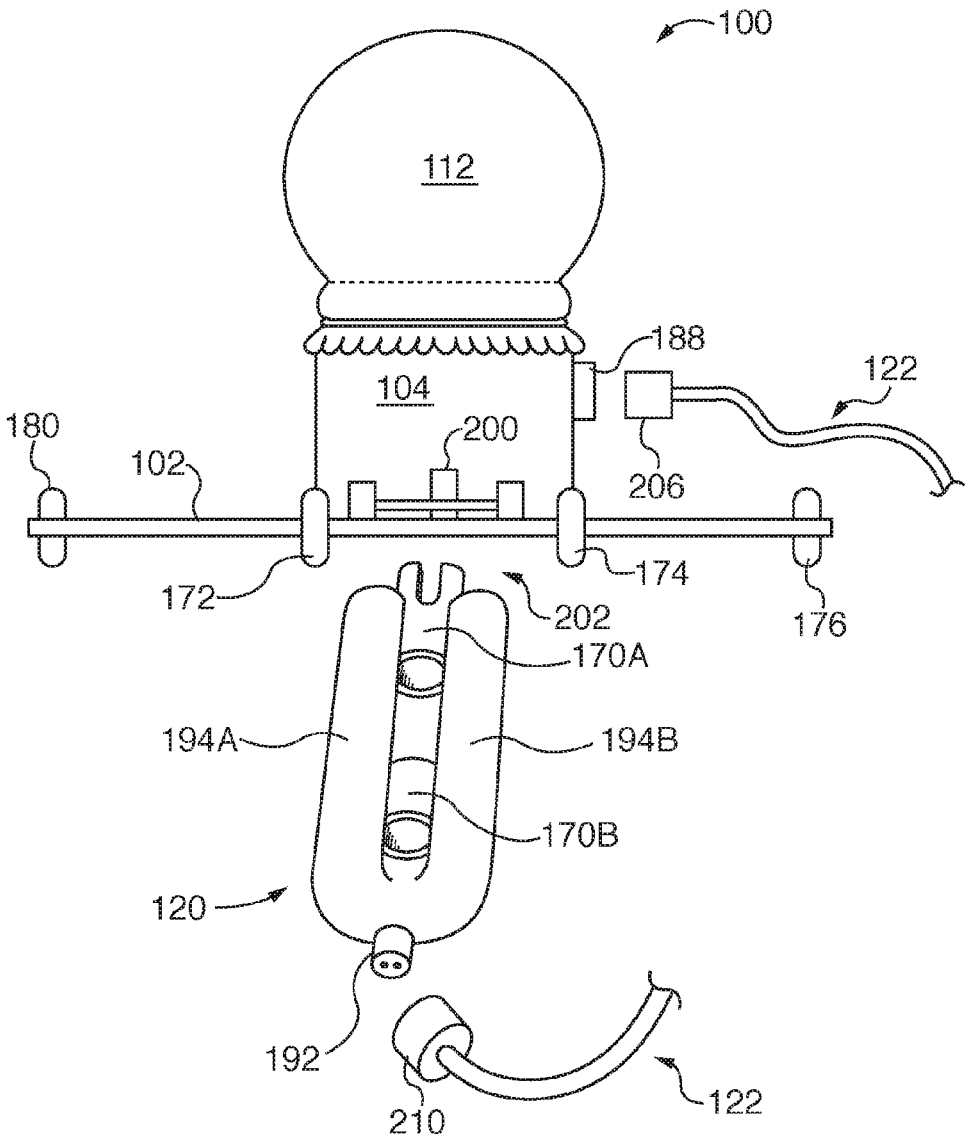
FIG. 15 is a partially perspective view of a mobile powered filtering apparatus, according to at least one further aspect of the disclosure.

FIG. 15 shows a mobile powered filtering apparatus 100 which is an alternative to the implementations of FIGS. 1 and 14. In mobile powered filtering apparatus 100 of FIG. 15, submersible motor 116 (see FIG. 2) includes a first submersible electrical connector 188 accessible from an exterior of propeller housing 104. Submersible battery pack 120 comprises first submersible electrical terminal 192. Electrical conductor 122 terminates at one end 204 in a second submersible electrical connector 206 configured to mechanically engage and electrically connect to first submersible electrical connector 188 of submersible motor 116 and, at another end 208 in a second submersible electrical terminal 210 configured to mechanically engage and electrically connect to first submersible electrical terminal 192 of submersible battery pack 120. Electrical conductor 122 is removably attachable to first submersible electrical connector 188 of submersible motor 116 and to first submersible terminal 192 of submersible battery pack 120. First submersible electrical connector 188 of submersible motor 116, second submersible electrical connector 206 of electrical conductor 122, first submersible electrical terminal 192 of submersible battery pack 120, and second submersible electrical terminal 210 of electrical conductor 122 each meet IEC standard IP65. Mobile powered filtering apparatus 100 of FIG. 14 is in other ways the structural and functional equivalent of mobile powered filtering apparatus 100 of FIG. 1.

Figure 16:
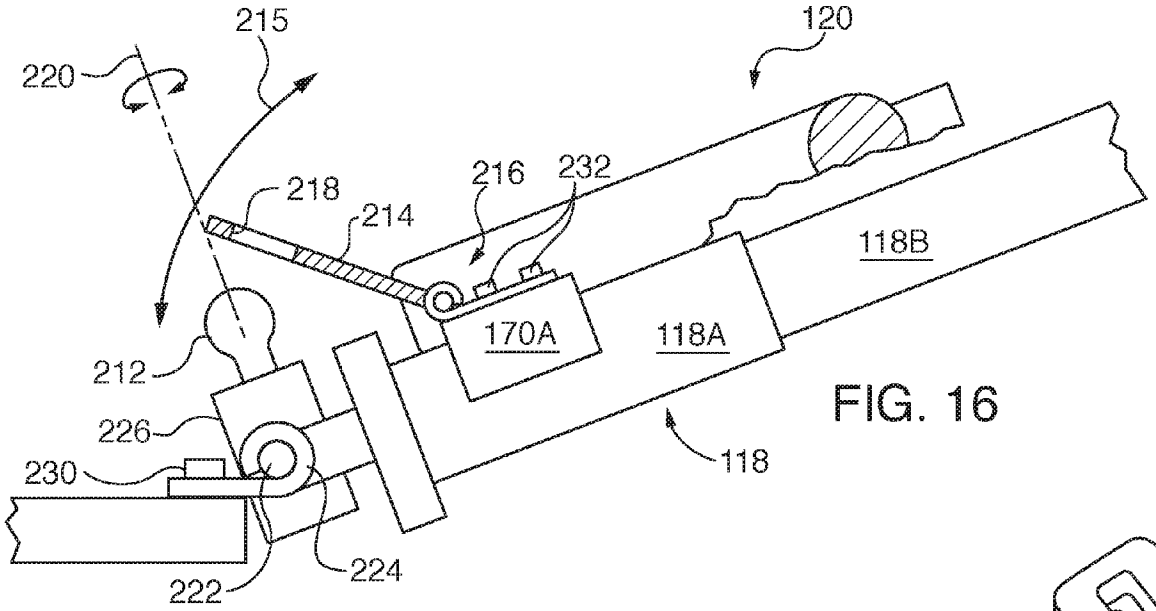
FIG. 16 is a side detail view showing an alternative to the battery connection shown in FIG. 15.
Figure 18:
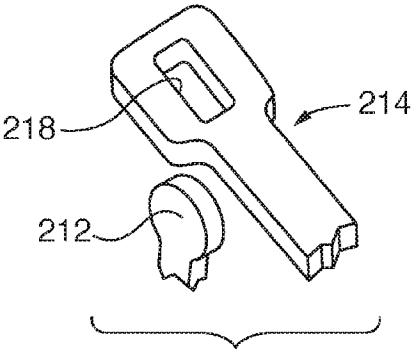
FIG. 18 is is a perspective detail view of the hasp and head shown towards the left of FIG. 17.
Figure 19:
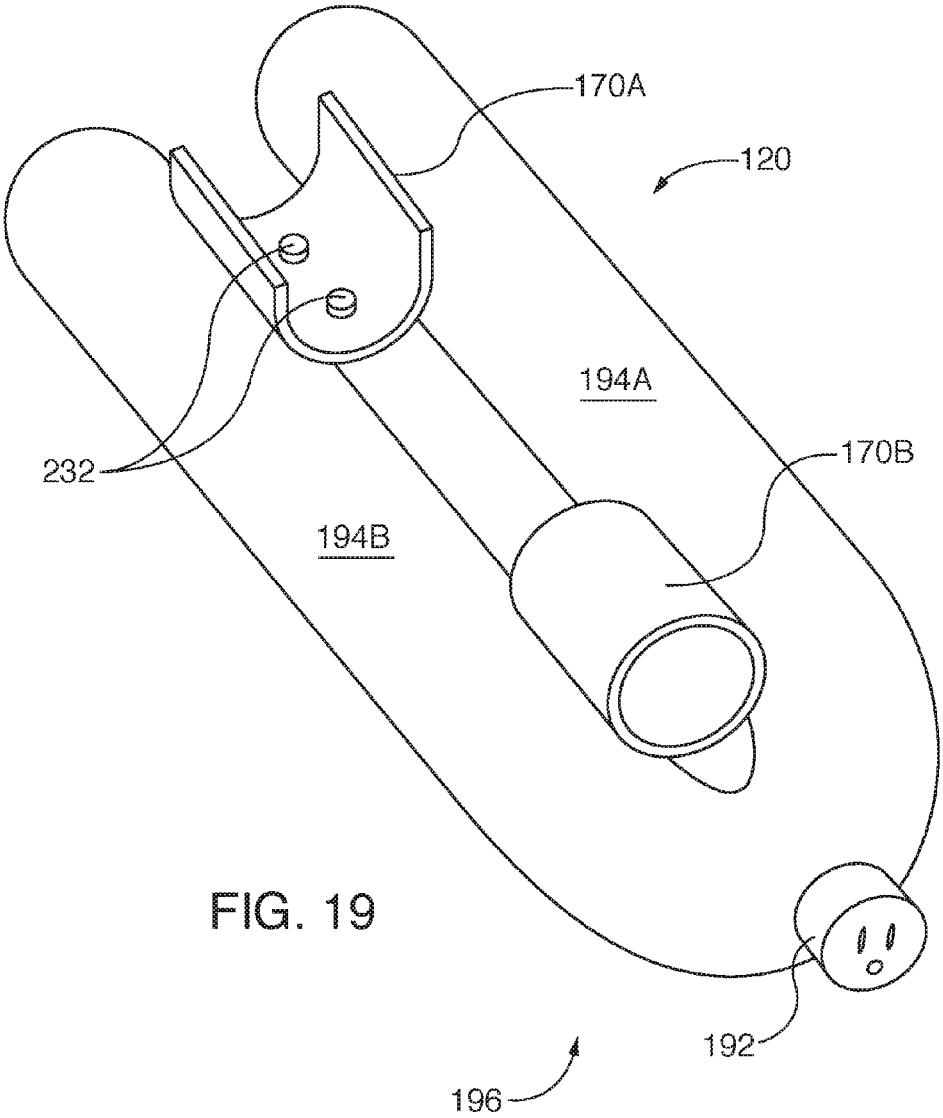
FIG. 19 is a persepective bottom view of the battery partially shown in FIG. 16.

FIG. 16 shows a mobile powered filtering appliance 100 (not shown in its entirety), featuring an alternative connection of submersible battery pack 120. Chassis 102 includes a rotatable locking head 212. Submersible battery pack 120 includes a hasp 214 alignable and engageable with rotatable locking head 214 when submersible battery pack 120 is installed on elongated handle 118. Rotatable locking head 214 can be rotated to interlock with hasp 214 after passing through hasp 214 and to release hasp 214 from engagement therewith. Hasp 214 engages a hinge 216 secured to sleeve 170A, and can pivot as indicated by an arrow 215. Because hasp 214 secures submersible battery pack 120 to chassis 102, sleeve 170A may be modified from the encircling tubular configuration shown in FIG. 11 to the semi-tubular configuration shown in FIGS. 16 and 19. FIG. 19 provides a view of submersible battery pack 120, shown inverted from previous depictions. It may be seen from FIG. 18 that a slot 218 is configured to pass rotatable locking head 212 with the latter in one position, but to retain rotatable locking head 212 when the latter has been rotated, for example by ninety degrees about an axis 220 (FIG. 16).

Figure 17:
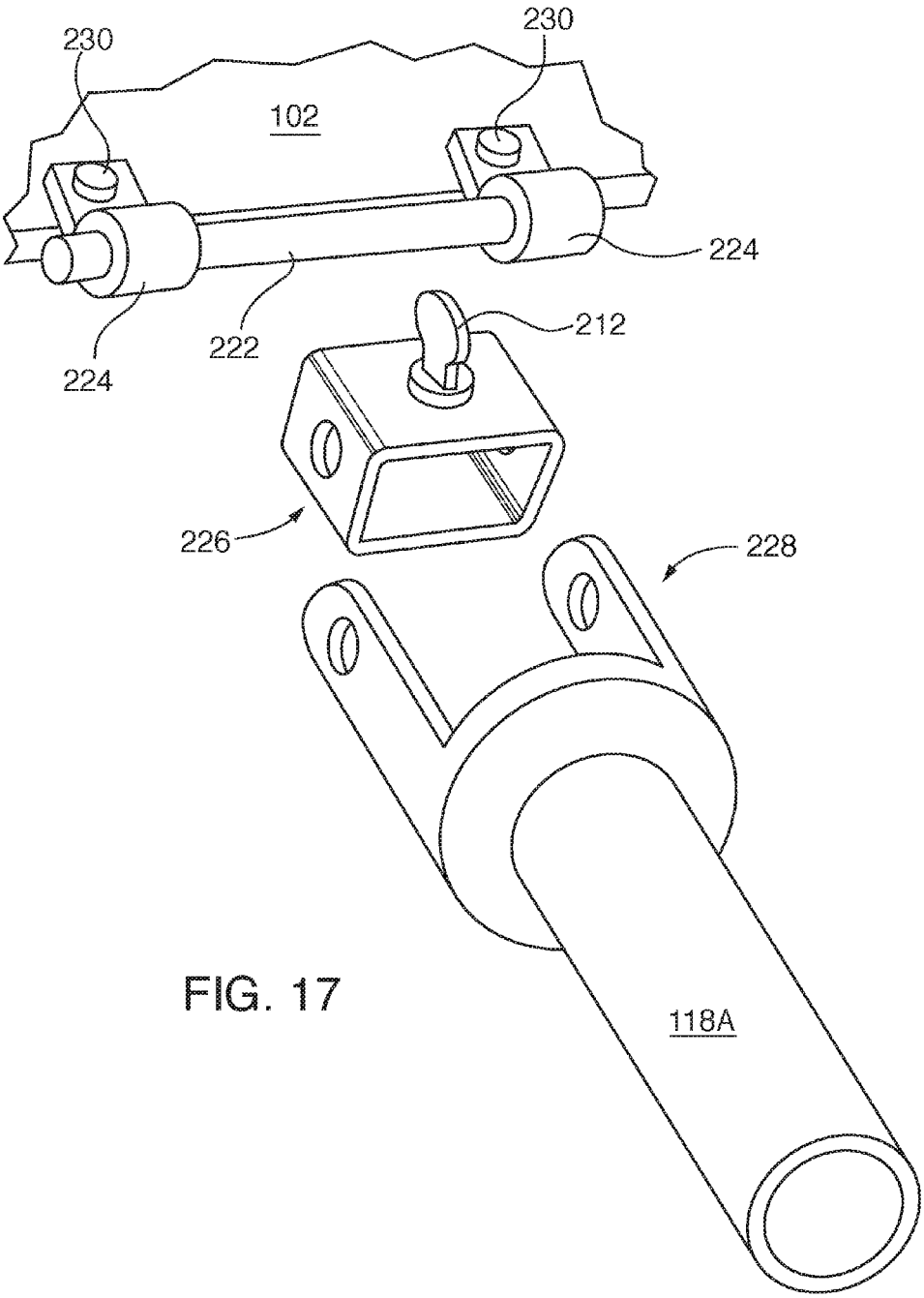
FIG. 17 is an exploded perspective detail view of FIG. 16, with the battery removed from view.

FIG. 16 also shows an optional construction wherein elongated handle 118 comprises a short stub shaft 118A and a telescoping elongated portion 118B. Mobile powered filtering appliance 100 of FIGS. 16 and 17 further comprises axle 222, yokes 224 securing axle 222 to chassis 102, and a floating base 226 captively encircling axle 222. Rotatable locking head 212 is on floating base 226. Axle 222 not only supports floating base 226, which is thereby enabled to pivot to a limited degree to facilitate insertion of rotatable head 212 through slot 218 of hasp 214, but also supports short stub shaft 118A. A clevis 228 engages axle 222 and straddles floating base 226 when mobile powered filtering appliance 100 is fully assembled.

Yoke 224 is secured to chassis 102 by suitable fasteners 230. Hinge 216 is secured to sleeve 170A by suitable fasteners 232.

While the disclosed concepts have been described in connection with what is considered the most practical and preferred implementation, it is to be understood that the disclosed concepts are not to be limited to the disclosed arrangements, but are intended to cover various arrangements which are included within the spirit and scope of the broadest possible interpretation of the appended claims so as to encompass all modifications and equivalent arrangements which are possible.

It should be understood that the various examples of the apparatus(es) disclosed herein may include any of the components, features, and functionalities of any of the other examples of the apparatus(es) disclosed herein in any feasible combination, and all of such possibilities are intended to be within the spirit and scope of the present disclosure. Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples presented and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims.

I claim:

1. A mobile powered filtering apparatus for filtering solid objects from a structure containing water, comprising:

a chassis assembly, further comprising
- a chassis,
- a propeller and a propeller housing mounted to the chassis;
- a submersible electric motor drivingly coupled to the propeller;
- a filter;
- an elongated handle coupled to the chassis;

a submersible battery pack separate from the chassis and attachable to the chassis assembly and mounted along the length of the elongated handle, wherein the submersible battery pack comprises a yoke adapted to engage and be retained on the elongated handle; and an electrical conductor electrically connecting the submersible electric motor to the submersible battery pack.

2. The mobile powered filtering apparatus of claim 1, wherein the filter is adapted to arrest debris in water propelled by the propeller.

3. The mobile powered filtering apparatus of claim 2, wherein the filter is removably attachable to the propeller housing.

4. The mobile powered filtering apparatus of claim 1, wherein the electrical conductor is flexible along at least part of its length.

5. The mobile powered filtering apparatus of claim 1, wherein the electrical conductor is rigid along at least part of its length.

6. The mobile powered filtering apparatus of claim 1, wherein the submersible electrical connector of the submersible motor and the submersible terminal of the electrical conductor each meet IEC standard IP65.

7. The mobile powered filtering apparatus of claim 1, wherein the battery pack includes two parallel battery compartments mutually communicating at one end of each of the two parallel battery compartments.

8. The mobile powered filtering apparatus of claim 7, wherein the electrical conductor exits the battery pack at the mutually communicating one end of each of the two parallel battery compartments.

9. A mobile powered filtering apparatus for filtering solid objects from a structure containing water, comprising:

a chassis assembly, further comprising a chassis, a propeller and a propeller housing mounted to the chassis;

a submersible electric motor drivingly coupled to the propeller;

a filter;

an elongated handle coupled to the chassis;

a submersible battery pack separate from the chassis and attachable to the chassis assembly and mounted along the length of the elongated handle; and an electrical conductor electrically connecting the submersible electric motor to the submersible battery pack, wherein the chassis and the submersible battery pack collectively include a keying arrangement constraining the submersible battery pack from rotating about the elongated handle when the submersible battery pack is in operative position mounted on the elongated handle.

10. The mobile powered filtering apparatus of claim 9, wherein the chassis includes a rotatable locking head and the submersible battery pack includes a hasp alignable and engageable with the rotatable locking head when the submersible battery pack is installed on the elongated handle, wherein the rotatable locking head can be rotated to interlock with the hasp after passing through the hasp and to release the hasp from engagement therewith.

11. The mobile powered filtering apparatus of claim 10, further comprising an axle, yokes securing the axle to the chassis, and a floating base captively encircling the axle, wherein the rotatable locking head is on the floating base.

12. The mobile powered filtering apparatus of claim 9, wherein one of the chassis and the submersible battery pack includes a tab and another one of the chassis and the submersible battery pack includes a fork configured to surround the tab in close cooperation therewith.

13. The mobile powered filtering apparatus of claim 12, wherein the tab is on the chassis.

14. The mobile powered filtering apparatus of claim 12, wherein the tab is on the battery pack.

15. A mobile powered filtering apparatus for filtering solid objects from a structure containing water, comprising:

a chassis assembly, further comprising a chassis, a propeller and a propeller housing mounted to the chassis;

a submersible electric motor drivingly coupled to the propeller;

a filter;

an elongated handle coupled to the chassis;

a submersible battery pack separate from the chassis and attachable to the chassis assembly and mounted along the length of the elongated handle; and an electrical conductor electrically connecting the submersible electric motor to the submersible battery pack, wherein the submersible motor includes a submersible electrical connector accessible from an exterior of the propeller housing; and the electrical conductor is integral with the submersible battery pack and terminates in a submersible terminal configured to mechanically engage and electrically connect to the submersible electrical connector of the submersible motor.

16. A mobile powered filtering apparatus for filtering solid objects from a structure containing water, comprising:

a chassis assembly, further comprising a chassis, a propeller and a propeller housing mounted to the chassis;

a submersible electric motor drivingly coupled to the propeller;

a filter;

an elongated handle coupled to the chassis;

a submersible battery pack separate from the chassis and attachable to the chassis assembly and mounted along the length of the elongated handle; and an electrical conductor electrically connecting the submersible electric motor to the submersible battery pack, wherein:

the electrical conductor is integral with the submersible electric motor and terminates in a submersible electric connector; and the submersible battery pack comprises a submersible electrical terminal configured to mechanically engage and electrically connect to the submersible electrical connector of the electrical conductor of the submersible motor.

17. The mobile powered filtering apparatus of claim 16, wherein the submersible electrical connector of the submersible motor and the submersible terminal of the electrical conductor each meet IEC standard IP65.

18. A mobile powered filtering apparatus for filtering solid objects from a structure containing water, comprising:

a chassis assembly, further comprising a chassis, a propeller and a propeller housing mounted to the chassis;

a submersible electric motor drivingly coupled to the propeller;

a filter;

an elongated handle coupled to the chassis;

a submersible battery pack separate from the chassis and attachable to the chassis assembly and mounted along the length of the elongated handle; and an electrical conductor electrically connecting the submersible electric motor to the submersible battery pack, wherein the submersible motor includes a first submersible electrical connector accessible from an exterior of the propeller housing;

the submersible battery pack comprises a first submersible electrical terminal; and the electrical conductor terminates at one end in a second submersible electrical connector configured to mechanically engage and electrically connect to the first submersible electrical connector of the submersible motor and at another end in a second submersible electrical terminal configured to mechanically engage and electrically connect to the first submersible electrical terminal of the submersible battery pack; and the electrical conductor is removably attachable to the first submersible electrical connector of the submersible motor and to the first submersible terminal of the submersible battery pack.

19. The mobile powered filtering apparatus of claim 18, wherein the first submersible electrical connector of the submersible motor, the second submersible electrical connector of the electrical conductor, the first submersible electrical terminal of the submersible battery pack, and the second submersible electrical terminal of the electrical conductor each meet IEC standard IP65.

* * * * *